US008119047B2

(12) United States Patent
Moore et al.

(10) Patent No.: US 8,119,047 B2
(45) Date of Patent: Feb. 21, 2012

(54) IN-SITU METHOD OF FORMING A NON-ROTATING DRILL PIPE PROTECTOR ASSEMBLY

(75) Inventors: N. Bruce Moore, Aliso Viejo, CA (US); Eric J. O'Neal, Buena Park, CA (US); Sarah B. Mitchell, Tustin, CA (US)

(73) Assignee: WWT International, Inc., Houston, TX (US)

( * ) Notice: Subject to any disclaimer, the term of this patent is extended or adjusted under 35 U.S.C. 154(b) by 297 days.

(21) Appl. No.: 12/074,787

(22) Filed: Mar. 5, 2008

(65) Prior Publication Data

US 2008/0217063 A1 Sep. 11, 2008

Related U.S. Application Data

(60) Provisional application No. 60/905,389, filed on Mar. 6, 2007.

(51) Int. Cl.
*B29C 45/14* (2006.01)
*B29C 45/02* (2006.01)

(52) U.S. Cl. ..... 264/242; 264/250; 264/255; 264/257; 264/275

(58) Field of Classification Search ..... None
See application file for complete search history.

(56) References Cited

U.S. PATENT DOCUMENTS 2,308,316 A * 1/1943 Smith et al. ..... 175/325.7
2,368,415 A * 1/1945 Grant ..... 175/325.7
2,657,956 A 11/1953 Hall, Sr.
2,801,700 A 8/1957 Hall, Sr.
(Continued)

FOREIGN PATENT DOCUMENTS

GB 2 282 615 A 4/1995
(Continued)

OTHER PUBLICATIONS

Notification of Transmittal of the International Search Report and the Written Opinion of the International Searching Authority, or the Declaration; International Application No. PCT/US2008/003053; International Filing Date Jun. 6, 2008; Mailing Date Jul. 8, 2008.

*Primary Examiner* — Edmund H. Lee
(74) *Attorney, Agent, or Firm* — Christie, Parker & Hale, LLP

(57) ABSTRACT

A non-rotating drill pipe protector sleeve is molded in situ around a drill pipe tubing. The inner surface of the molded protector sleeve can be shaped to form a fluid bearing during use. Fixed stop collars may be molded in situ in the same mold and bonded to the tubing at opposing ends of the molded sleeve. Alternatively, a flexible sleeve liner made from a material having a hardness less than that of the sleeve's molding material can be used as a mold insert around the tubing. The liner can be bonded to the molded sleeve material when the sleeve is molded around the liner. The interior surface of the liner can be shaped to form a fluid bearing for the inside surface of the molded sleeve. Reinforcing inserts and wear pads can be placed in the mold region of the sleeve. Chemical and/or mechanical bonding is provided between the liner reinforcement and the material from which the sleeve is molded. Reinforcing inserts and wear pads also can be placed in the mold regions for the stop collars.

11 Claims, 5 Drawing Sheets

U.S. PATENT DOCUMENTS

| | | | | | |
|---|---|---|---|---|---|
| 3,180,436 | A | | 4/1965 | Kellner et al. | |
| 3,491,182 | A | | 1/1970 | Hunder et al. | |
| 3,754,609 | A | | 8/1973 | Garrett | |
| 3,820,611 | A | | 6/1974 | King | |
| 3,948,575 | A | * | 4/1976 | Rosser | 175/325.2 |
| 3,999,811 | A | | 12/1976 | Gray | |
| 4,099,564 | A | | 7/1978 | Hutchison | |
| 4,171,560 | A | | 10/1979 | Garrett | |
| 4,199,011 | A | | 4/1980 | Kreft et al. | |
| 4,258,804 | A | | 3/1981 | Richey et al. | |
| 4,274,840 | A | | 6/1981 | Housman | |
| 4,379,494 | A | | 4/1983 | Sheshtawy | |
| 4,384,483 | A | | 5/1983 | Dellinger et al. | |
| 4,436,118 | A | | 3/1984 | Garrett | |
| 4,458,404 | A | | 7/1984 | Garrett | |
| 4,603,982 | A | | 8/1986 | Dittrich | |
| 4,634,314 | A | | 1/1987 | Pierce | |
| 4,708,203 | A | | 11/1987 | Walker | |
| 5,009,826 | A | | 4/1991 | Walker | |
| 5,046,558 | A | | 9/1991 | Koster | |
| 5,069,297 | A | | 12/1991 | Krueger et al. | |
| 5,132,069 | A | | 7/1992 | Newton | |
| 5,294,396 | A | * | 3/1994 | Dressel et al. | 264/240 |
| 5,332,049 | A | | 7/1994 | Tew | |
| 5,363,929 | A | | 11/1994 | Williams et al. | |
| 5,364,909 | A | | 11/1994 | Guo et al. | |
| 5,474,132 | A | | 12/1995 | Gallagher | |
| 5,604,266 | A | | 2/1997 | Mushovic | |
| 5,692,563 | A | | 12/1997 | Krueger et al. | |
| 5,803,193 | A | | 9/1998 | Krueger et al. | |
| 5,833,018 | A | | 11/1998 | von Gynz-Rekowski | |
| 5,833,019 | A | | 11/1998 | Gynz-Rekowski | |
| 5,866,218 | A | | 2/1999 | Meuth | |
| 5,901,798 | A | | 5/1999 | Herrera et al. | |
| 5,902,656 | A | | 5/1999 | Hwang | |
| 5,937,948 | A | | 8/1999 | Robbins, III | |
| 6,032,748 | A | | 3/2000 | DeBray et al. | |
| 6,250,405 | B1 | | 6/2001 | Moore et al. | |
| 6,312,637 | B1 | * | 11/2001 | Evans et al. | 264/275 |
| 6,378,633 | B1 | | 4/2002 | Moore et al. | |
| 6,513,223 | B1 | | 2/2003 | Angman et al. | |
| 6,725,939 | B2 | | 4/2004 | Richard | |
| 6,739,415 | B2 | | 5/2004 | Mitchell et al. | |
| 7,055,631 | B2 | | 6/2006 | Mitchell et al. | |
| 7,195,730 | B2 | | 3/2007 | Calderoni et al. | |
| 2002/0117337 | A1 | | 8/2002 | Moore et al. | |
| 2005/0224123 | A1 | | 10/2005 | Baynham et al. | |
| 2006/0196036 | A1 | * | 9/2006 | Male et al. | 29/527.1 |
| 2007/0131414 | A1 | | 6/2007 | Calderoni et al. | |

FOREIGN PATENT DOCUMENTS

| | | | |
|---|---|---|---|
| GB | 2 400 124 | A | 10/2004 |
| GB | 2 423 739 | A | 9/2006 |
| WO | WO 02/02904 | A1 | 1/2002 |
| WO | WO 02/48501 | A1 | 6/2002 |

* cited by examiner

IN-SITU METHOD OF FORMING A NON-ROTATING DRILL PIPE PROTECTOR ASSEMBLY

CROSS-REFERENCE

This application claims the priority benefit of U.S. Provisional Application No. 60/905,389, filed Mar. 6, 2007, incorporated herein in its entirety by this reference.

FIELD OF THE INVENTION

This invention relates to wear protectors for rotating drill pipe and casing used in oil and gas exploration or recovery, and more particularly, to an in-situ molded non-rotating drill pipe protector and its end stops or collars.

BACKGROUND

Non-rotating drill pipe protectors are disclosed in several US patents held by Western Well Tool, Inc. (WWT), including U.S. Pat. No. 5,069,297; U.S. Pat. No. 5,803,193; U.S. Pat. No. 6,250,405; U.S. Pat. No. 6,378,633; U.S. Pat. No. 6,739,415; and U.S. Pat. No. 7,005,631. Each of these patent publications is incorporated herein in their entirety by this reference. These several patents describe a non-rotating drill pipe protector consisting of a stop collar and sleeve. The stop collar and sleeve are hinged to allow assembly onto drill pipe in the field.

Also described in the patents listed are numerous design features that allow increased performance in torque reduction, drag reductions, improved wear resistance, resistance to being moved on the drill pipe, and improved flow-by characteristics. These patents also describe structures that produce a "fluid bearing" function between the non-rotating drill pipe protector sleeve and the drill pipe.

The performance characteristics described in the WWT patents are reflected in the incorporation of specialty materials such as (1) rubber for a sleeve liner to improve the fluid bearing and hence the torque reduction of the drill pipe, and (2) ultra high molecular weight polyethylene for wear and sliding pads to reduce friction between the stop collar and sleeve and of the sleeve to the casing. Special materials such as aluminum are used in the stop collars to facilitate a flexible structure that can grip a variety of pipe diameters. Specially formulated urethanes are used in the sleeve body to provide resistance to a variety of downhole fluids. Specialty steel reinforcement is used to provide a long fatigue dependent operational life.

These performance characteristics are also reflected in the particular shape of the assembly, especially the drill pipe protector sleeves. The sleeves have external recessed areas that allow flow past the sleeve to be less restricted (reduced Effective Circulating Density, ECD). Shape is important on the ends of the sleeves to have channels to allow fluid to escape from the sleeve and lubricate the interface of the sleeve to the stop collar. The shape of the sleeve is also important to facilitate sliding on the low friction pads, and hence, in one embodiment, the sleeve profile is made of multiple large diameter arcs.

Most recently, ProBond (International), Ltd., Aberdeen, U.K. has disclosed a wear protector method and apparatus in US Patent Publication No. US 2006/0196036 ('036) that describes wear protectors both as rotating and non-rotating. These wear protectors are of various configurations that are formed by injection of a composite molding material directly into removable molds on the drill pipe. In addition, UK Patent GB 2,388,390 ('390) describes strips of ceramic material attached to a cage-like structure that is hinged. The '036 and '390 references are incorporated herein in their entirety by this reference.

A purpose of the present invention is to expand the potential use of an injection molded non-rotating drill pipe protector to incorporate numerous additional features that are available with hinged non-rotating drill pipe protectors. All special features would also be applicable to rotating drill pipe protectors and to casing centralizers.

SUMMARY OF THE INVENTION

A molded non-rotating drill pipe protector is formed around a drill pipe (or casing) by placing an annular mold around the drill pipe, injecting a resinous molding material into the mold cavity to form a continuous ring-shaped drill pipe protector sleeve that surrounds the drill pipe, curing or hardening the molded sleeve material, and removing the mold. End caps (or stop collars) are also molded around the drill pipe at one or both ends of the molded sleeve. The molded end caps are bonded directly to the drill pipe surface so they function as rotating end stops. In use, they hold the molded protector sleeve in place on the drill pipe.

In one embodiment, an optional non-abrading sleeve liner, having a hardness less than that of the sleeve material, is placed in the mold as a mold insert, between the drill pipe outer surface and the molded sleeve material. The liner bonds to the injection molded sleeve material during curing or hardening. In use, the liner can produce a fluid bearing function between the drill pipe and protector sleeve. The liner can be formed with parallel flats and intervening grooves extending axially, to enhance the fluid bearing function.

Preferably, a mold release material is applied to the region between the drill pipe outer surface and the inside surface of the liner and/or the molded sleeve material, to avoid bonding of the sleeve to the drill pipe, so as to promote the non-rotating function of the protector sleeve during use. The mold release material can be a removable mold insert, or a chemical mold release material such as a silicone resinous material.

Other mold inserts also are positioned in the mold cavity to provide various design features for the molded protector sleeve. These mold inserts include circumferentially spaced apart low friction wear pads that extend axially and are positioned along the exterior surface of the molded sleeve. Circumferentially spaced apart wear pads exposed along the annular end surfaces of the protector sleeve also can be formed as mold inserts.

Similar mold inserts are positioned in the mold for forming the molded stop collars, to provide (1) low friction wear pads extending axially along the exterior surface of the stop collars, and (2) wear pads exposed along the annular end surfaces of the stop collars.

Structural reinforcements can be used as mold inserts when forming the molded stop collars.

Circumferentially spaced apart and longitudinally extending axial grooves are formed on the exterior surface of the molded protector sleeve for enhancing flow past the sleeve during use. Sleeve radial grooves can be formed at the exterior annular ends of the sleeve to enhance lubrication at the collar/sleeve interface during use. The axial and radial grooves may be molded by shaping the mold or using removable mold inserts during the molding process.

In one embodiment, a different resinous matrix may be used for the protector sleeve material at different locations in the sleeve, e.g., a soft resinous material for the inner liner and a resinous material having a greater hardness for the exterior portion of the sleeve. In this case there may exist a gradient of hardness across the protector sleeve but not the liner.

One means for bonding the liner to the protector sleeve comprises use of a chemical adhesive material for attaching the liner to the binder matrix when a continuous rubber liner is used. The liner in this instance is treated with a chemical bonding material that is compatible with and facilitates bonding to the resinous sleeve material.

Alternatively, the liner can comprise a metal mesh reinforcement with rubber flat elements bonded to the mesh. The mesh with rubber elements can be wrapped onto the pipe and then the matrix material used for the molded sleeve can be injected into the mold. The rubber flats can provide a sleeve liner interior surface having a fluid bearing function during use. Chemical treatment of both the mesh and rubber may be used before loading into the mold. In this method the resinous matrix material used for the molded protector sleeve bonds both with the rubber and the mesh and thus would comprise both a chemical and mechanical bond. Alternatively, the rubber/elastomeric liner may be reinforced by a flexible fiber, mesh or fabric reinforcement embedded in the molded liner material similar to the metal mesh. The fiber, mesh or fabric may protrude from the liner to provide a greater surface and structure for chemically and/or mechanically bonding to the molded resinous matrix of the sleeve.

In one embodiment, the sleeve and/or stop collars are molded by reaction injection molding techniques, in which the resinous molding material, typically a thermosetting resinous material, is injected into the mold cavity and then reacted with curing agents in the mold to cure or harden the protector sleeve and/or stop collar material within the mold.

These and other aspects of the invention will be more fully understood by referring to the following detailed description and the accompanying drawings.

DETAILED DESCRIPTION

This invention comprises a multi-component molded non-rotating drill pipe protector assembly, a molded rotating drill pipe protector assembly, and a molded rotating casing centralizer. Each of these is described.

(1) Molded Non-Rotating Drill Pipe Protector Assembly

Figure 1:
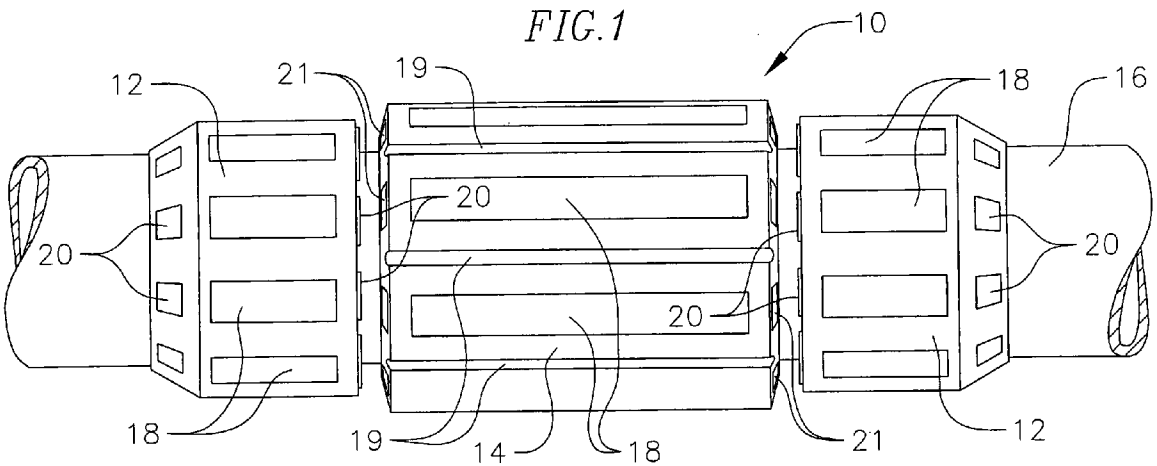
FIG. 1 is a side elevational view showing a molded non-rotating drill pipe protector sleeve on a drill pipe, together with a pair of molded stop collars at opposite ends of the sleeve.

Referring to FIG. 1, an in-situ molded non-rotating drill pipe protector assembly 10 has multiple parts consisting of two molded rotating stop collars 12 and a molded non-rotating drill pipe protector sleeve 14. Both the molded sleeve and collars are formed in situ as a continuous ring around a tubular drill pipe 16.

The mold used to form the drill pipe protector sleeve 14 and the stop collars 12 comprises semi-circular segments removably held together to form an annular mold surrounding the drill pipe. The mold segments are sealed at their juncture. The mold segments may be hinged along one boundary. Stop collar regions of the mold are isolated from the drill pipe protector sleeve portion of the mold. End seals and seals between the sleeve and the stop collars contain the molding materials and the mold inserts described below.

The sleeve and each collar have low friction wear pads 18 facing outwardly along their outer surfaces. Low friction wear pads 20 face outwardly along tapered end surfaces of the stop collars. Low friction wear pads 21 face outwardly around the annular ends of the molded protector sleeve.

Figure 2:
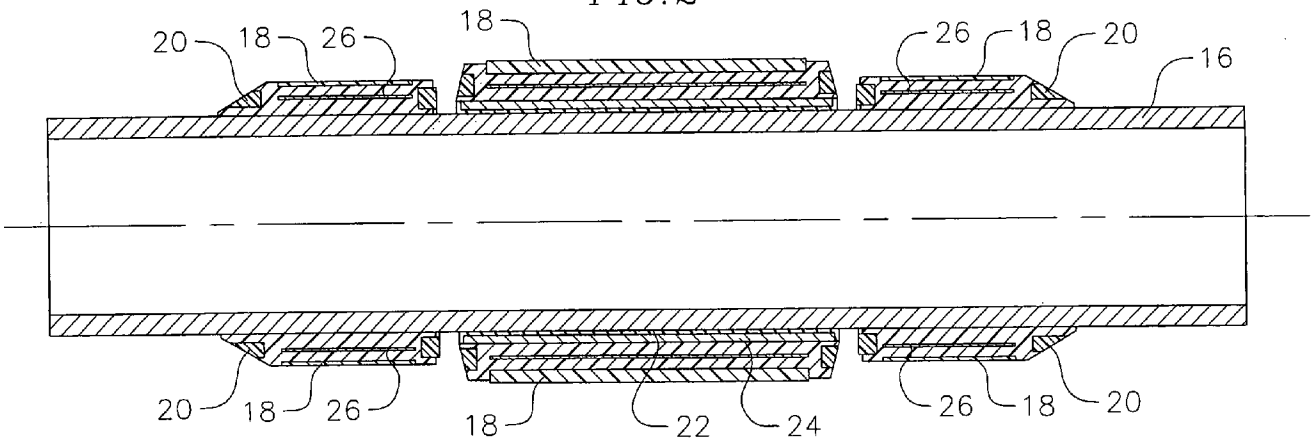
FIG. 2 is a cross-sectional view of the assembly shown in FIG. 1.

FIG. 2 shows the non-rotating molded sleeve 14 with its low friction wear pads 18 and a rubber/elastomeric inner liner 22 in cross-section. FIG. 2 also shows parallel axial grooves 19 on the outer surface of the protector sleeve. The wear pads 18, 20 and 21 comprise mold inserts which are set into the sleeve and collar molding material. The inner liner 22 is bonded to the inside of the sleeve. The molded protector sleeve is free to rotate around the drill pipe, retained axially by the stop collars which are adhered to the drill pipe by the molding process. This embodiment also shows an annular reinforcing element 24 embedded in the molded protector sleeve, and an annular reinforcing element 26 embedded in each molded stop collar.

Figure 3:
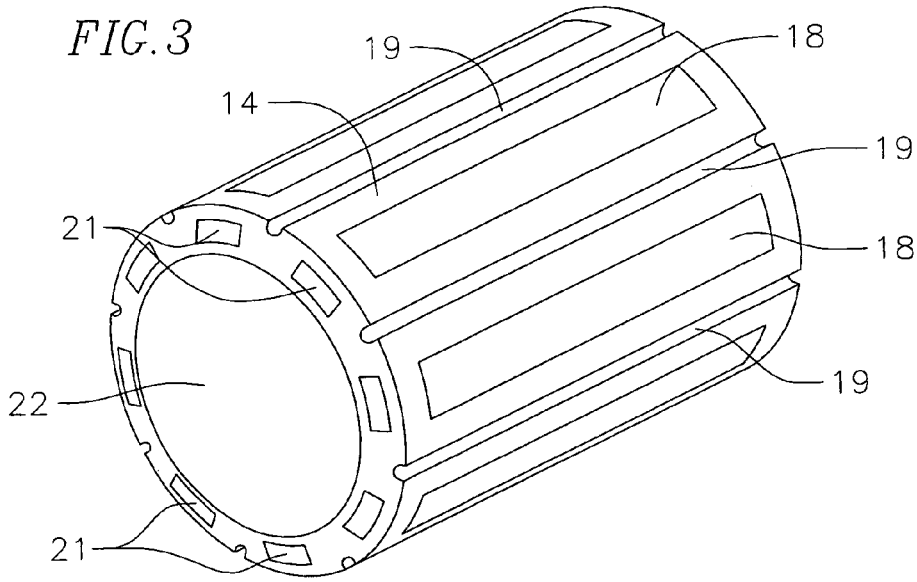
FIG. 3 is a perspective view showing a non-rotating molded sleeve.

FIG. 3 shows the molded non-rotating sleeve in perspective with the low friction wear pads 18 spaced apart circumferentially and extending axially along the outer surface of the protector sleeve 14. Also shown are the wear pads 21 which are spaced apart around the annular outer ends of the sleeve. The rubber/elastomeric sleeve liner 22 forms the inside surface of the sleeve.

Figure 4:
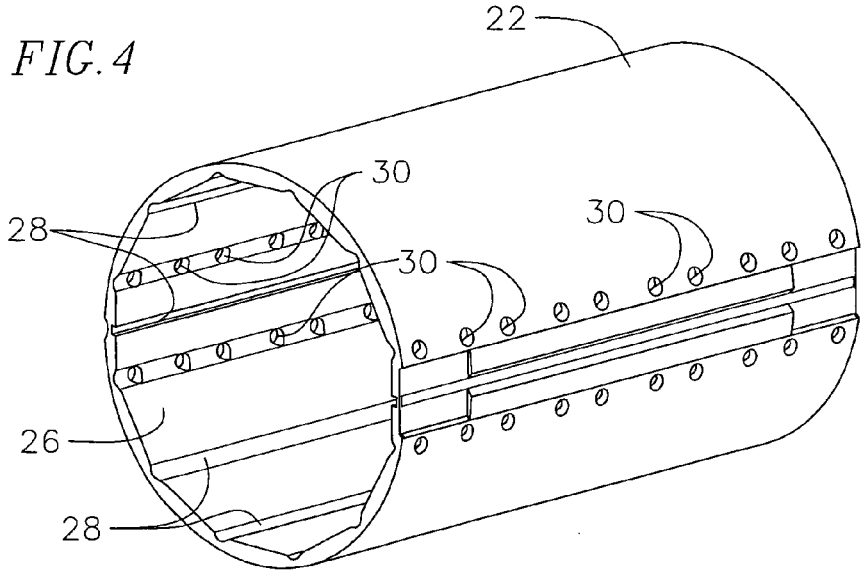
FIG. 4 is a perspective view showing a sleeve inner liner.

FIG. 4 shows a one-piece tubular sleeve inner liner 22. The tubular sleeve inner liner has a roughened outer surface for increased adhesion to the inside of the protector sleeve 14. The interior surface of the liner has axially extending, circumferentially spaced apart parallel flats 26 for enhanced fluid bearing performance. Parallel axial grooves 28 are formed between the flats. Axially spaced apart holes 30 along the grooves form a means of anchoring to the molded protector sleeve material. The rubber/elastomer is at a proper hardness to create the proper fluid bearing.

Figure 5:
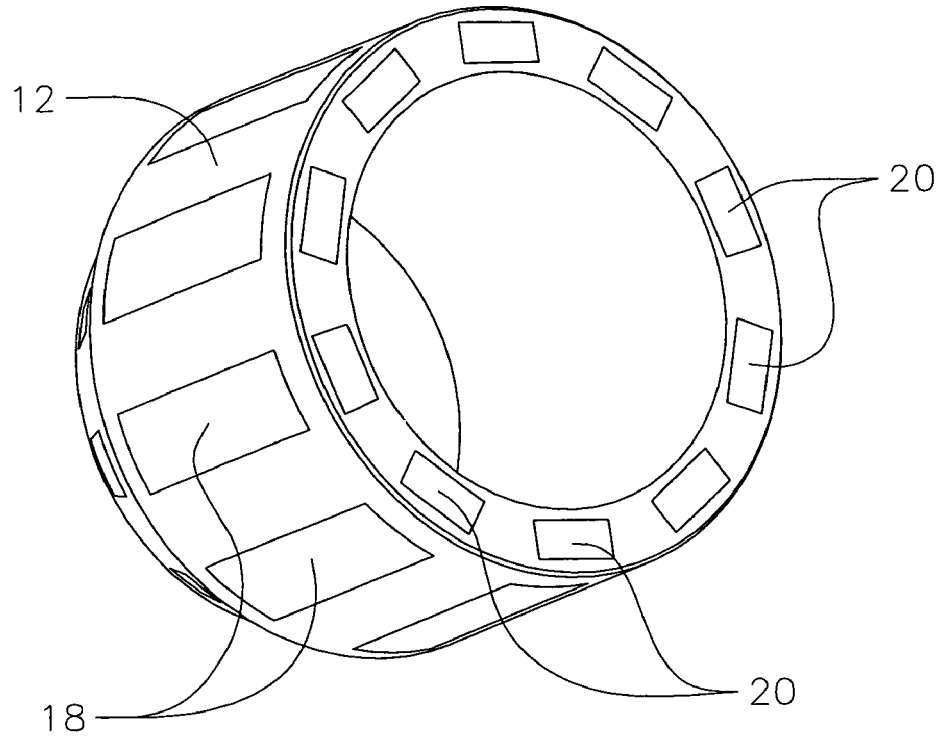
FIG. 5 is a rear perspective view showing a molded stop collar.

FIG. 5 shows a rear view of the molded stop collar 12 with the circumferentially spaced apart wear pad inserts 20 on the annular end of the collar, for increased wear resistance.

Figure 6:
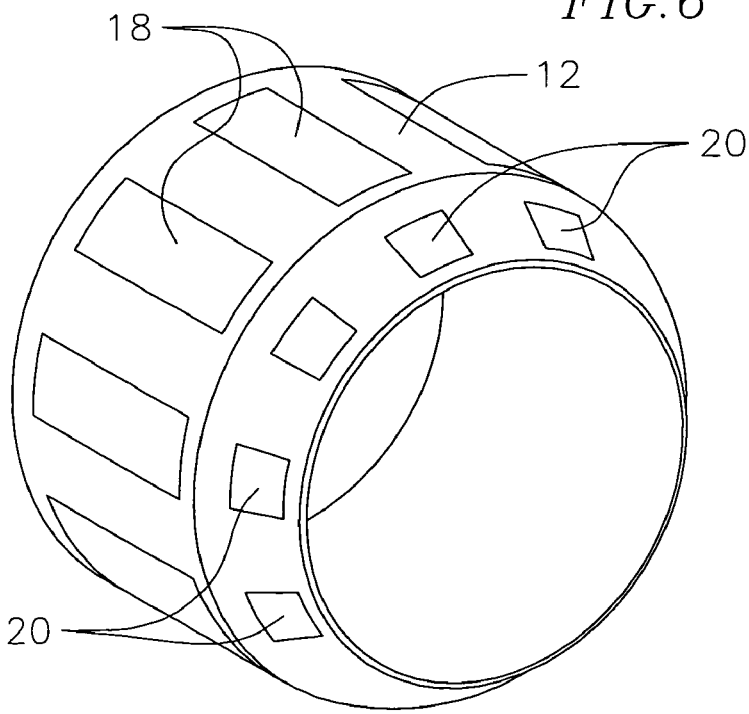
FIG. 6 is a front perspective view showing the opposite end of the molded stop collar of FIG. 5.

FIG. 6 shows the molded stop collar 12 from a front view and the low friction inserts 20 spaced apart around the tapered end section of the collar.

Figure 7:
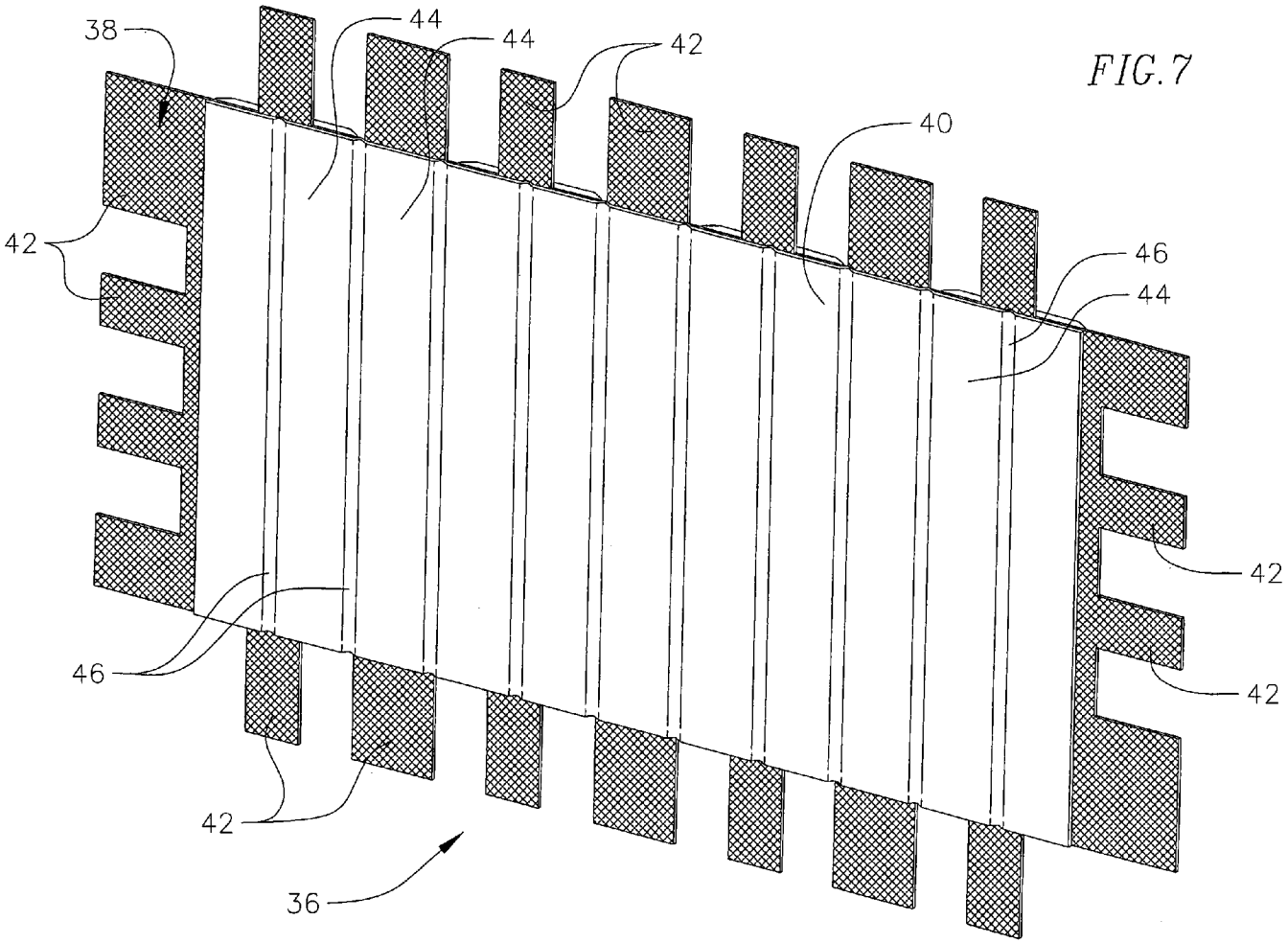
FIG. 7 is a perspective view showing a reinforced sleeve inner liner in a flat form.

FIG. 7 shows a flat molded sleeve liner 36 having a reinforcement 38 which may comprise fiber, mesh or fabric reinforcing materials. The mesh-like material can comprise a woven polymeric fiber material. The reinforcement is embedded (preferably by casting integrally with the molded rubber/elastomer material) in the molded sleeve material 40 for reinforcing its low hardness material. The reinforcement has a continuous, preferably rectangular base structure, preferably long enough to encompass the OD of the drill pipe. The fiber, mesh or fabric portion of the reinforcement protrudes along the edges of the liner. As shown in FIG. 7, these protruding regions are notched to form short tabs 42 spaced apart by alternating notched areas 44 along the length and width of the reinforcement. The tabs are preferably rectangular and the notched areas parallel to one another. The one embodiment, the tabs are wider when aligned with the flats 44 of the molded rubber/elastomeric liner. The tabs are narrower when aligned with the axial grooves 46 in the liner. The molded rubber/elastomeric portion of the reinforced sleeve liner includes the axial groves 44 which were spaced parallel between the flats 46 that provide an increased fluid bearing performance during use. The protruding tabs, preferably along all edges of the liner, provide a mechanical fastening feature for the molded resinous matrix to flow through and chemically bond to. A flat mold for the liner can aid in positioning the continuous piece of fiber, mesh or fabric through the center of the liner. A silicone rubber seal may be used to prevent flash from filling the protruding fiber, mesh or fabric during molding of the liner. The fiber, mesh or fabric may be coated with a bonding agent to facilitate chemical adhesion to both the soft elastomeric/polymeric liner material and the molded matrix material.

Figure 8:
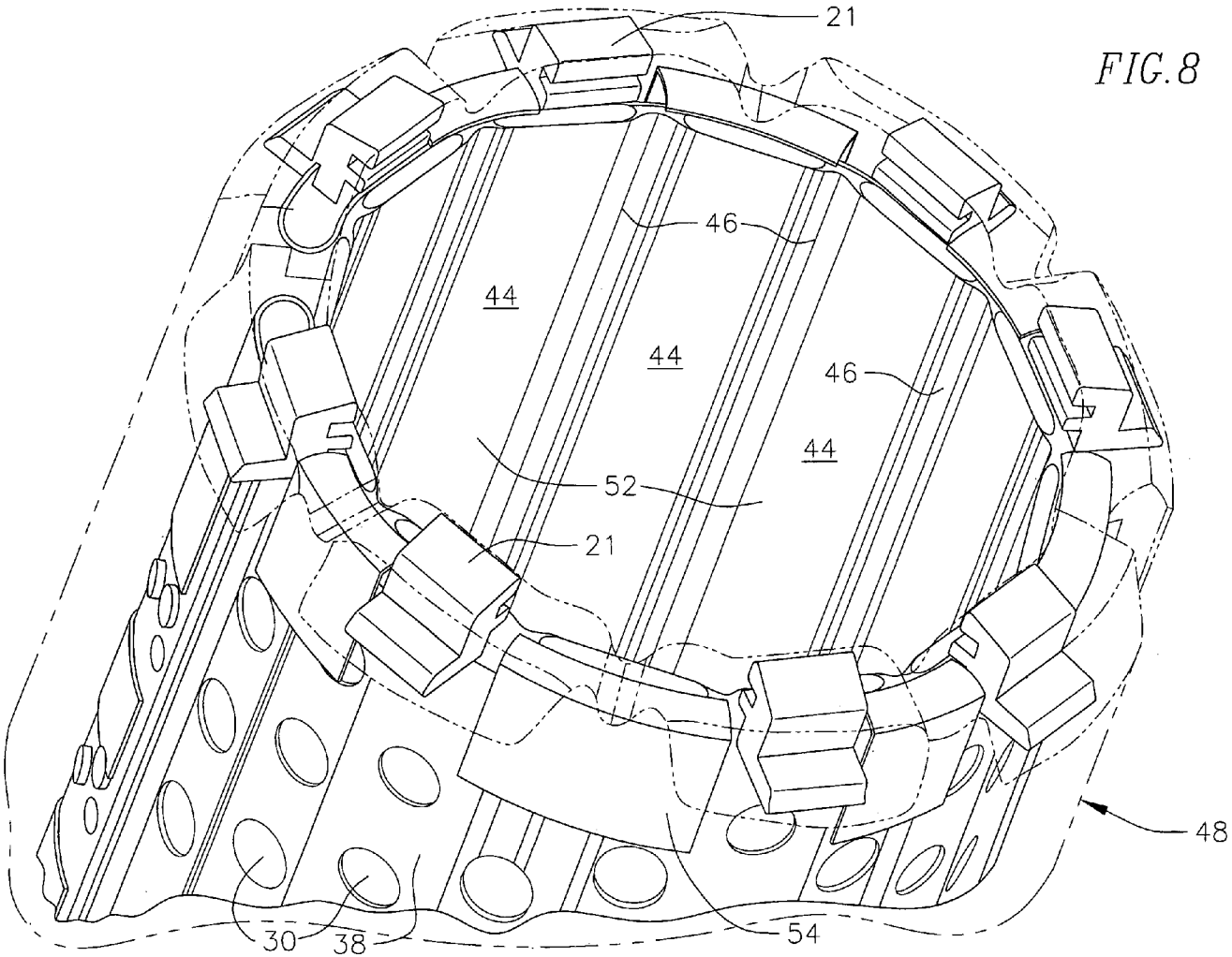
FIG. 8 is a fragmentary perspective view, partly broken away, showing a non-rotating molded protector sleeve containing the reinforced inner liner of FIG. 7.

FIG. 8 shows the non-rotating molded protector sleeve 48 with the embedded reinforcing inner liner 36. This view is broken away to show the sleeve reinforcement 38 which in this instance contains holes 30 to enhance bonding of the reinforcement to the molded matrix material of the protector sleeve 48. The molded matrix material is shown (for example at 50) around the OD of the protector sleeve. The molded rubber/elastomeric material of the liner is shown, for example, at 52. The wear pads 21 are shown spaced apart around the annular end of the sleeve. The fiber or mesh reinforcement is chemically bonded and mechanically held in place by the molded matrix 54, for example.

Several test prototypes of NRDPPs have been made from urethane as the protector sleeve matrix with the mesh reinforcement for the rubber liner. Side loading tests were conducted to measure the coefficient of friction (COF) from the fluid bearing. A COF of 0.03-0.04 was produced. Conclusions were that use of the mesh-rubber liner does not diminish the performance characteristics of the non-reinforced (only rubber) liner, but does add greater "holding power" of the liner in the sleeve, thus reducing field failures of the liners.

In use, a bonded interface is formed between the stop collars and the outer surface of the drill pipe. There is an absence of bonding between the protector sleeve (or the sleeve liner) and the outer surface of the drill pipe, to produce a non-rotating function during use.

The stop collar 12 comprises a polymeric resinous material (matrix) and multiple additional constituents. Integral to the stop collars are the wear resistant inserts or low friction inserts. The inserts may be positioned at different locations and may use different materials. First, insert materials are located near the sleeve collars and are used to increase the wear life and/or reduce the friction between the stop collar and the sleeve.

The stop collars are configured with a taper at one end to allow smooth transition across downhole variations in diameter of the hole or casing. The inserts 18 may be incorporated into external surfaces to help reduce wear or susceptibility to impact damage. The inserts may be of various configurations including distributed pads or semi-circular wear elements. The inserts may have various holes or extensions that allow for better flow of the injectable material into, around, and between the inserts. Further discussion of materials follows in the next section; single type or multiple types of inserts may be used.

The inserts that form the wear pads can be incorporated into the stop collar in several ways. First, they may be loaded into receptacle shapes within the mold, and thus held in place for the injection molding process. Further, it may be necessary to have a rapidly removable mechanical attachment for the inserts, such as a releasable gripper. Alternatively, the several inserts can be held together with a mesh or similar structure, then the entire mesh-insert assembly placed on the pipe, then the molding material (matrix) injected into the mold, and then the shape cured. Alternatively, multiple ports for injection into the mold may be used. One material can be used for the side adjacent to the sleeve and another for a second material for the remaining part of the collar. In this way, a matrix that is more wear resistant can be applied to the area next to the sleeve, and a more tenacious material can be used for the remaining part of the stop collar.

Also incorporated into the stop collar are the specific shapes of the annular end of the collar juxtaposed to the sleeve. This may include a variety of shapes, but in particular, various inclined shapes of 15-30 degrees allow better centralizing of the sleeve relative to the stop collar and assist with preventing the sleeve from slipping over the collar under load.

The protector sleeve 14 comprises of an injection moldable resinous material (matrix) with specific geometric shapes and/or inserts. The interior of the sleeve can be of many different shapes including circular, circular with a multiplicity of lateral running and axially extending parallel channels, and/or with a multiplicity of flat sections that make up the arc with lateral channels. The use of multiple flat sections with lateral channels produce a fluid bearing similar to that described in the referenced US patents to WWT.

The protector sleeve interior shape may be formed by either the molded shape of the matrix or by the use of an insert to be positioned adjacent the drill pipe. The insert may be of various materials including thermoset plastic, thermoplastics, elastomers, composites of polymers and additives (metallic or organic), preferably with a relatively low hardness (40-90 Shore hardness) that facilitates formation of a fluid bearing and reduced tendency for the sleeve to abrade the pipe during operations.

The exterior surface of the protector sleeve may be of several different configurations depending upon the application. The shape may be circular, circular with longitudinal grooves, multi-lobed, multi-lobed with longitudinal grooves. The insertion of lateral grooves on the exterior will increase the ease that flow passes the assembly, thus reducing the pressure drop across the assembly, frequently measured as Effective Circulation Density (ECD).

The sleeve exterior ends may have various shapes. The ends may be shaped as smooth surfaces or may incorporate a multiplicity of radial grooves. These grooves allow the flow of fluid between the stop collar and sleeve end, tending to provide lubricity and cleaning of debris, thus increasing the wear life of the assembly.

(a) Materials

A wide variety of materials may be used for the inserts, matrix material, and other adhesives. For the matrix material, a wide variety of thermoplastic, thermosetting, elastomeric materials as single materials and as composites may be used.

A partial list of thermoplastics includes acrylic, thermoplastic elastomers such as ether and ester based polyurethanes (TPE), polycarbonate, polyetherketone (PEK), polyetheretherketone (PEEK). polyphenylene oxide (PPO), polyarylamide (PARA), polyvinylidene fluoride (PVDF), ethylene butyl acrylate, ethylene vinyl acetate, fluoropolymers (FET, PFA, PTFE), ionomer, polyamides (nylon) (all types), polyamide ionide, polyarylsulfone, polyester (PE), polycarbonate (PC), polyethylene (LDPE, HDPE, UHMWPE), polyimide, polypropylene (PP), polystyrene (PS), polysulfone (PSU), acrylonitrile butadiene styrene (ABS), polyurethane, polyphenylene sulfide (PPS), polyether sulfone (PES), acetals (POM), rapid prototyping materials, and vinyl (PVC, CPVC).

A partial list of thermoset materials includes adhesives, carbon fiber/thermoset composites, cyanoacrylate, elastomers, epoxy, fluoropolymers, furane, phenolic, melamine, polyester, polyurethane, polyurea, silicone, vinyl ester, and composites which may include various particles, particular shapes (spheres, tetrahedrons, cubes, flat and smooth shapes) chopped fiber, continuous fiber, fabric, laminates of fiber and matrix (both wet and prepreg). A partial list of additives includes ceramic powders, asbestos, glass, carbon, polyamide fibers (kevlar), and polyethelyne (spectra). Fibers may be incorporated as chopped fiber (various orientations), unidirectional fibers (stands and tows), fabric (woven or multilayered) as well as combinations of these.

The mold inserts can be of various materials depending upon their purpose. Structural inserts may include plastics, composites, or metals such as steel or aluminum. Inserts used to reduce sliding friction such as on the exterior of the sleeve, the ends of the sleeve, and top and ends of the stop collar, low friction material may be used, such as ultra high molecular weight polyethylene, polytetrafluoroethylene (Teflon), perfluoroalkyoxy-polymers (PFA or Partek), Rulon and other PTFE composites (Teflon/metal/mineral composite), and other materials. In other areas, wear resistant material can be used to increase product wear characteristics. Such materials include ceramics, composites with wear resistant fibers such as glass, polyamide, or carbon, and fiber re-enforced composites. Other materials may be added to increase lubricity in an area; to accomplish this graphite or molybdenum disulfide can be used. Finally, inserts may be added to provide a low friction or a fluid bearing between the drill pipe and non-rotating protector sleeve, such as rubbers, polyurethanes or other elastomers.

Mold release material is used under the sleeve section to prevent adhesion to the drill pipe or casing. Silicone grease, oils, and special purpose greases may be used.

The protector sleeve may contain a low hardness material nearest the drill pipe, adjacent the liner. Use of softer materials tends to prevent scouring of the drill pipe by debris. Elastomers, low modulus urethanes, or other soft materials may be used. The liner may be of a continuous piece (a shell), or discrete pieces, or discrete pieces bonded together with fiber, mesh, or fabric.

(b) Process

A variety of processes may be used to mold the product on the drill pipe; these include reaction injection molding (RIM), transfer molding, thermoforming, or pressure plug assisted molding. These processes are well documented in various texts and electronic media.

One preferred method is reaction injection molding, and for this process preferred materials used are epoxies. The injection device can be electric, hydraulic, or hybrid, but would be portable to go to the yard where the drill pipe would be stored.

Using the reaction injection molding method can involve the following process steps.

(1) Drill Pipe Preparation: Each drill pipe that will have the product installed is mechanically cleaned (sand blast, bead blast), then chemically cleaned (acetone, toluene, solvents), and a mold release is applied such as silicone or organic petroleum based mold release.

(2) Mold Preparation: Each mold part is prepared (which depending upon the environment may require mold heating). If various mold inserts are used, then the inserts are installed into the mold and temporarily held in place by mechanical devices (receptacles and ridges, removable clamps, dissolvable constraints, vacuum) or chemical attachment (releasable adhesive, dissolvable fiber).

(3) Mold Installation: The mold segments are placed around the drill pipe (or casing) and sealed and can be mechanically held in place with straps or clamps.

(4) Injection of Matrix (Matrices): The selected matrix (matrices) materials are injected through injection ports into the mold. The matrix material may be pre-heated to facilitate the injection process. The temperature is dependent upon the type of matrix material. For some designs, it may be useful to use multiple matrices. In this approach different matrices would be injected into different regions of the mold. For example, matrix (1) can be a highly tenacious epoxy that helps secure the portion furthest from the sleeve and matrix (2) can be a more wear resistant matrix for the ends of the stop collar nearest the sleeve. Similarly, different matrices may include different additives to improve wear or reduce friction.

(5) Mold Curing: The molding material may be chemically cured at room temperature, or cured at an elevated temperature. The heat may be applied by various means including heating blankets, induction heating, or other portable heating systems such as tents or portable furnaces. The temperature and time at temperature are determined for the type of material and desired mechanical properties. For example, using an epoxy material would require temperatures of 200° F. and up to 24 hours curing. The mold is held in place until the curing process is completed and once the sleeve and collar materials have cured, the mold can be removed.

(c) Product Variations

Several product variations for the molded non-rotating drill pipe protector may be incorporated into the assembly.

External Longitudinal Channels in the Sleeve Body: Multiple longitudinal channels (parallel to the axis of length of the sleeve) can be incorporated in the outer surface of the sleeve. The channels allow greater ease for fluids to pass the protector and thus lower the pressure drop across the assembly. This has many benefits while drilling including improved hole cleaning, better hole stability, easier surface operations. For a protector sleeve used on 5-inch drill pipe, typically 4-8 channels will be used each with an approximate width of 1.5 inches and depth of about 0.5 inches.

Radial Channels in the Sleeve Ends: Multiple radial grooves may be incorporated into the ends of the sleeves. These grooves allow debris to exit the assembly and provide fluid that may act as a lubricant between the collar and the sleeve. Typically for an assembly installed on 5-inch diameter drill pipe 6-10 radial grooves may be used, which are about ¼ inch in width and extend about one inch into the body of the sleeve.

Sleeve Interior Shape: The interior of the sleeve may be molded with a curved or circular shape or with a polygonal-like shape, when viewed from the end. The preferred embodiment is a polygonal shape with multiple axial grooves as this helps the formation of a fluid bearing, thus lowering the torque between the sleeve and the drill pipe.

Sleeve Liner: The sleeve may incorporate an internal liner. The liner can be made from a single piece of elastomeric material or other soft polymer (Shore hardness of 65-90), multiple strips of rubber, or multiple strips of rubber bonded to a mesh or fabric or other flexible member. A low hardness material tends to allow better formation of a fluid bearing between the sleeve and the drill pipe. The liner's external surface (adjacent to the drill pipe) can include one or more longitudinal or axial grooves and multiple regions flat surface regions (allowing the formation of a polyhedron-like shape when viewed from the end of the sleeve). These flats and channels allow the formation of an efficient fluid bearing. FIG. 4 shows a preferred configuration for a liner.

Structural Reinforcement: Various types of reinforcement may be incorporated into the molded sleeve or collar. The reinforcement may be fibers, fabric, or specially shaped cages. These reinforcements can be placed on the pipe or within the mold before the molding process. Materials may include carbon, glass. steel, and other reinforcement materials. Steel cages may be used as reinforcement. The cages can incorporate a multiplicity of holes to allow the matrix material to flow through the reinforcement to the boundaries of the mold.

(2) Molded Rotating Drill Pipe Protector

An injection molded rotating drill pipe protector can be made with special features which include the several types of inserts that can be molded into the sleeve. Specifically, low friction and wear resistant materials can be incorporated into the assembly. The sleeve is molded directly to the drill pipe surface as a continuous ring.

The materials and processes are the same as for the non-rotating drill pipe protector. The reinforcement may include metals and well as organic materials. For example, copper-beryllium or zinc may be used to increase the wear characteristics of the protector or casing centralizer.

A variety of physical variations may be incorporated into the rotating drill protectors. Some of these are listed:

(1) End Configurations: The ends of the rotating protector must be tapered to prevent hang up and or damage during run into the well. Various angles may be from 10-80 degrees, preferably a 30-45 degree taper.

(2) Longitudinal Grooves: The sleeve may incorporate various longitudinally or spirally shaped grooves. These grooves will improve the flow by of fluids and or cements during the run-in-hole mode of operation. The width of the ridges between the grooves may be optimized with respect to shape or materials to minimize friction or wear. For example, more rounded shapes will have less tendency to not damage casing when running the assembly into the hole.

A molded rotating casing centralizer can be molded to the drill pipe by techniques similar to the molded rotating drill pipe protector.

SUMMARY

The features of the invention disclosed are the following:

| Design Feature | Benefit |
|---|---|
| Insert - Low Friction Pads (external) | Reduces sliding friction of the assembly down the hole |
| Insert - Wear Pads | Increases wear life on surfaces including external sleeve and/or ends of the collar and sleeve |
| Insert - Sleeve Liner | Promotes development of fluid bearing which reduces rotational torque, reduces wear on drill pipe between protector and pipe. |
| Sleeve Longitudinal Grooves | Increases flow by the tool, reduces pressure drop, helps drilling, helps casing move down hole. |
| Sleeve Radial Grooves | Helps clean debris out of the sleeve assembly, helps lubricate the collar sleeve interface. |
| Collar - Sleeve Interface (taper angle) | Shape enhances the tendency for the sleeve to remain next to the collar rather than slide over it during Running in or out of the hole |

-continued

| | Benefit |
|---|---|
| Structural Reinforcement (Sleeve) | Increases the strength of the assembly, helps resist damage during sliding or when stripping through Blow Out preventer Increases fatigue life. Increase resistance to impact damage. |
| Process Feature | |
| Reaction Injection Process with inserts held in molds | Ease of field installation |
| Installation of unified inserts (sleeve) | Ease of field installation |
| Low temperature cure | Prevents damage to drill string, ease of operation |
| Modular Molds | Transportability to remote sites |

Further details of the present invention are described in U.S. Provisional Application No. 60/905,389, incorporated herein by reference.

What is claimed is:

1. An in situ method of forming a non-rotating drill pipe protector assembly on a downhole tubing for use in a wellbore, the method comprising:

placing a mold around the downhole tubing; sealing the mold at its ends against the tubing, leaving a first mold space within the mold around the tubing; placing a preformed annular sleeve liner in the first mold space adjacent the surface of the tubing, the sleeve liner having a tubing-contacting portion thereof made from a fluid bearing material having a hardness less than the hardness of a resinous molding material to be inserted in the first mold space, the sleeve liner having an inner surface formed by spaced apart, axially extending parallel grooves positioned between axially extending parallel substantially flat surface regions for contacting the outer surface of the tubing, the axial grooves providing a flow path to circulate fluid therethrough to form a non-rotating fluid bearing between the tubing and the liner, in which the sleeve liner comprises a mold insert formed by having bonded a rubber/elastomeric material to a flexible fiber, mesh or fabric reinforcing element adapted to encompass the tubing, and in which the flat surface regions of the fluid bearing-shaped inner surface of the liner are formed by parallel spaced apart axial sections of the rubber/elastomeric material bonded to the reinforcing element of the mold insert, inserting a resinous molding material in the mold space to fill the first mold space and bond the molding material to at least a portion of the sleeve liner; providing a mold release material in the mold space that inhibits bonding of the sleeve liner to the tubing; curing the resinous molding material in the first mold space to form a drill pipe protector sleeve in situ around the tubing; and removing the mold from its position around the tubing to thereby provide a molded non-rotating drill pipe protector sleeve having an inner surface providing a circumferentially-reinforced non-rotating fluid bearing formed by the liner to which the sleeve has been molded and bonded.

2. The method according to claim 1 in which the liner includes an embedded reinforcing element selected from materials comprising a metal mesh reinforcement or a woven polymeric fiber material.

3. The method to claim 1 in which the mold includes a second mold space adjacent and isolated from the first mold space, and inserting a molding material in the second mold space to form a molded stop collar bonded to the tubing adjacent the sleeve.

4. The method according to claim 1 including placing wear pads for the molded sleeve as mold inserts in the first mold space.

5. The method according to claim 1 including placing end pads and side pads for the stop collar as mold inserts in the second mold space.

6. The method according to claim 5 including holding the end pads and/or the side pads in a fixed position in the mold by connections to a reinforcement disposed in the second mold space.

7. The method according to claim 1 including placing a reinforcement in the first mold space to reinforce molded sleeve, and placing a separate reinforcement in the second mold space to reinforce the stop collar.

8. The method according to claim 1 including molding axial grooves in an OD of the molded sleeve, and molding radial grooves in an annular end of the sleeve.

9. The method according to claim 1 in which the sleeve molding material comprises a urethane resinous material.

10. The method according to claim 1 in which the mesh reinforcing element comprises metal or a woven polymeric fiber material.

11. The method according to claim 10 in which the sleeve molding material comprises a urethane resinous material.

* * * * *